US007033041B2

(12) United States Patent
Parker et al.

(10) Patent No.: US 7,033,041 B2
(45) Date of Patent: Apr. 25, 2006

(54) CONVERTIBLE FLASHLIGHT

(75) Inventors: David H. Parker, Torrance, CA (US); Kevin Deighton, Long Beach, CA (US)

(73) Assignee: Pelican Products, Inc., Torrance, CA (US)

( * ) Notice: Subject to any disclaimer, the term of this patent is extended or adjusted under 35 U.S.C. 154(b) by 150 days.

(21) Appl. No.: 10/755,908

(22) Filed: Jan. 12, 2004

(65) Prior Publication Data

US 2005/0152134 A1 Jul. 14, 2005

(51) Int. Cl.
*F21L 4/00* (2006.01)

(52) U.S. Cl. ..... 362/199; 362/197; 362/188

(58) Field of Classification Search ..... 362/202, 362/191, 188, 197, 205, 199
See application file for complete search history.

(56) References Cited

U.S. PATENT DOCUMENTS 5,097,399 A * 3/1992 Gammache ..... 362/197
D350,618 S 9/1994 Parker
5,410,457 A 4/1995 Parker
D383,558 S 9/1997 Parker
5,871,272 A 2/1999 Sharrah et al.
6,012,824 A * 1/2000 Sharrah et al. ..... 362/199
6,523,972 B1 2/2003 Sharrah et al.
6,802,623 B1 * 10/2004 Hsu et al. ..... 362/199
2003/0112624 A1 6/2003 Quittner

* cited by examiner

*Primary Examiner*—Laura K. Tso
(74) *Attorney, Agent, or Firm*—Greenberg Traurig LLP

(57) ABSTRACT

A flashlight including a longitudinal barrel and a head with an angular connector between the longitudinal barrel and the head. The angular connector is rotatable about the longitudinal axis thereby to direct the head in different radial directions relative to the barrel. The connector is also removable so that the head can be directly connected to the barrel. A finger operable toggle on the switch permits operation of the flashlight between the on and off positions, and the contact with the switch permit operation irrespective of the angular position of the angular connector.

14 Claims, 6 Drawing Sheets

CONVERTIBLE FLASHLIGHT

BACKGROUND

This Invention relates to a flashlight. In particular, the invention is concerned with a versatile flashlight for use in different environments such as emergency environments where a flashlight may need to be supported on the clothing of a user.

Different flashlight configurations are known. It is also known to have flashlights where the angular relationship of the head is different to the longitudinal direction of the barrel, the barrel normally housing batteries for the flashlight. Flashlights with the angular relocated head on its own or with the longitudinally located head may be more limited in their versatility than is desirable.

It is an object of the present invention to provide a versatile flashlight.

SUMMARY

The flashlight includes a longitudinally-directed barrel and an angular connector between the barrel and the head of the flashlight. The angular connector can permit for the head to be located in different radial directions around a circumference relative to the longitudinal direction of the barrel.

In other situations, the angular connector can be removable and the head can be directly located at the uppermost part of the barrel.

When the angular connector is used, the angular relationship can be such that different radial positions can be taken for the head around a circumference of the longitudinal access of the barrel.

A switch for the flashlight is located towards the upper part or leading end of the barrel. The switch includes a finger-operable toggle and there are contacts operable by the switch so as to close a circuit between a battery located in the barrel and a bulb located in the head.

The invention is further described with reference to the accompanying drawings.

DRAWINGS

DESCRIPTION

Figure 1:
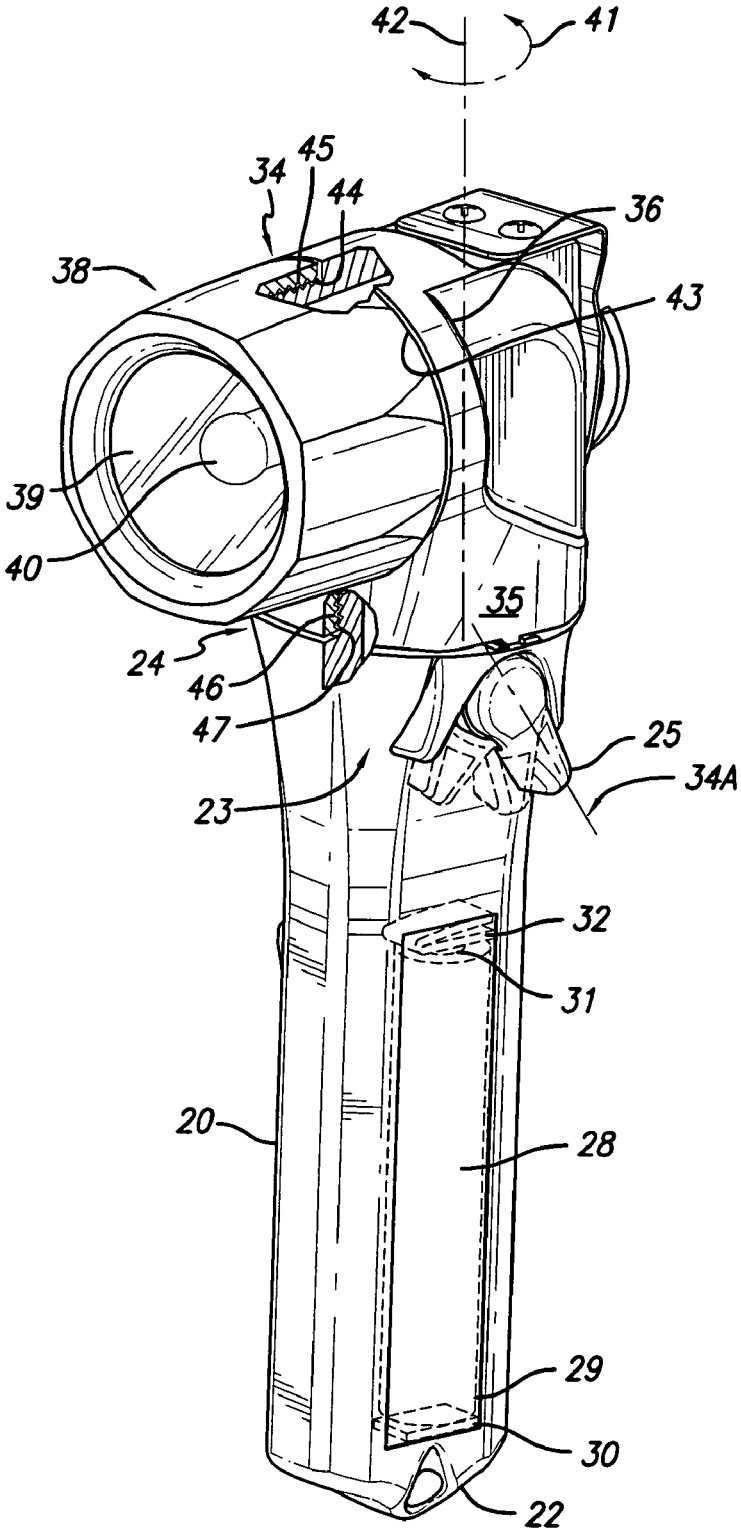
FIG. 1 is a perspective view of a flashlight showing a longitudinally-directed barrel with an angular connector and a head connected to the angular connector.

A flashlight comprises a barrel for receiving a battery. The barrel has a longitudinal axis and extending between a top and a base. There is a head on the barrel having a lens and a bulb. A removable angular connector is located between the head and the barrel, and is relatively moveable in relationship to the barrel along the longitudinal axis through the barrel. As such the head can be directed to selected different radial directions relative to the longitudinal axis.

The angular connector can be a right angular formation whereby the head is directed substantially perpendicular to the longitudinal axis through the barrel. As such the head can be located in a selected radial right angular direction relative to the longitudinal direction extending through the barrel.

When removed the head can be located with the barrel without the angular connector thereby to have a configuration for the flashlight wherein the head is longitudinally located with the barrel.

A switch with an electrical contact permits for electrical closure and opening between the battery and the bulb thereby to permit operation of the flashlight to be on or off according to the position of the switch. In one form the switch is located on the barrel.

There is a clip for securing of flashlight on a support which is selectively a relatively thin substrate selectively an item of clothing of a user of flashlight. The clip is formed on the angular connector and the clip is secured to the angular connector by anchorage to that connector in a position which is not in the longitudinal direction of the barrel.

The switch for operating the flashlight includes a radially mounted finger operable toggle, the axis of the toggle being substantially right angular to the longitudinal axis of the barrel. The switch is mounted on the barrel at a position adjacent to an upper part of the barrel. There is a contact operable with the switch whereby closure of the circuit is permissible irrespective of the radial position of the angular connector.

In some other forms the flashlight comprises a barrel for receiving a battery, the barrel having a longitudinal axis and extending between a top and a base. There is a head on the barrel having a lens and a bulb. The head is relatively moveable in relationship to the barrel whereby the head can be directed to selected different directions relative to the longitudinal axis. The contact is operable with the switch whereby closure of the circuit is permissible irrespective of the position of the head relative to the barrel. In this form there is no angular portion of the flashlight A flashlight includes a barrel 20 which has an octagonal cross-sectional configuration 21.

This configuration extends essentially from the base 22 of the barrel towards the upper part or leading end 23 of the barrel where the shape of the barrel is relatively flared outwardly from about three quarters of the way up the barrel from the base towards the upper part 23 of the leading end 24 of the barrel is relatively circular as indicated by 24.

Below the leading end 24 and in the upper part area 23, there is a finger-operable toggle 25 which is connected through a pin 26 which opens on the opposite side 60 of the barrel 20. There is a support clip 27 on the side 60 of the upper portion 23.

As such, the finger toggle 25 can turn about the pin 26 between positions wherein the finger toggle 25 can close contacts or open contacts in an electrical circuit where the electrical circuit includes a battery 28 located in the housing formed by the barrel 20. The one end 29 of the battery 28 makes connection with a contact 30 in the base 22 of the barrel 20. The opposite end 31 of the battery 28 makes connection with a contact 32 in the barrel 20. Closure of the circuit is affected by the switch-operated toggle 25.

Figure 2:
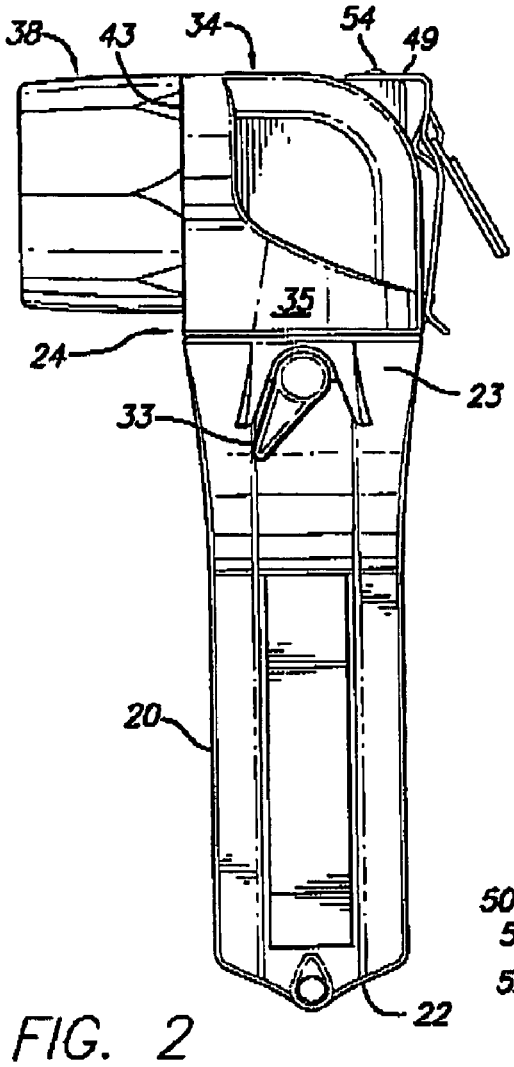
FIG. 2 is a side view of the flashlight as shown in FIG. 1.
Figure 3:
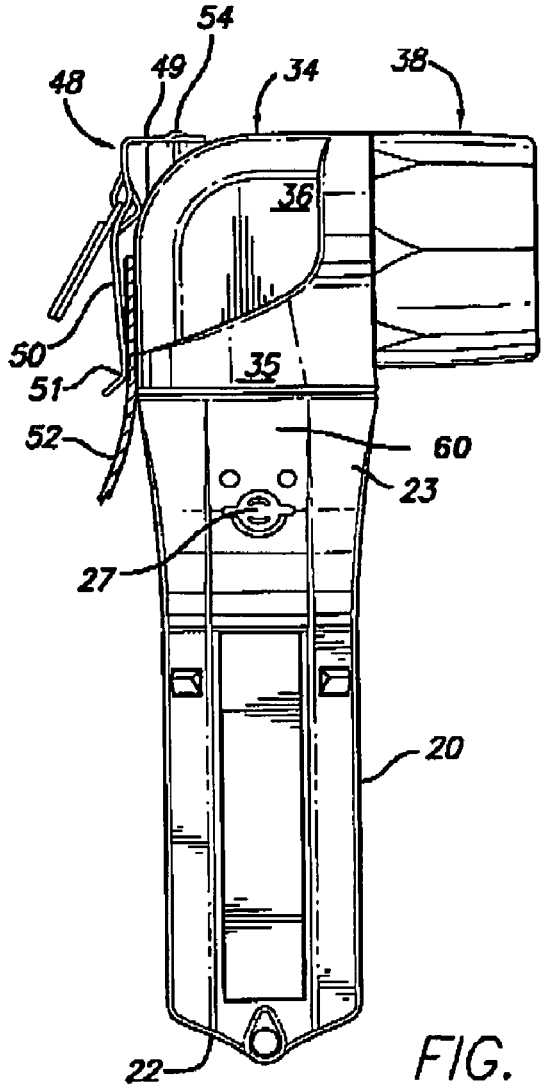
FIG. 3 is an opposite side view of the flashlight as shown in FIG. 1.
Figure 4:
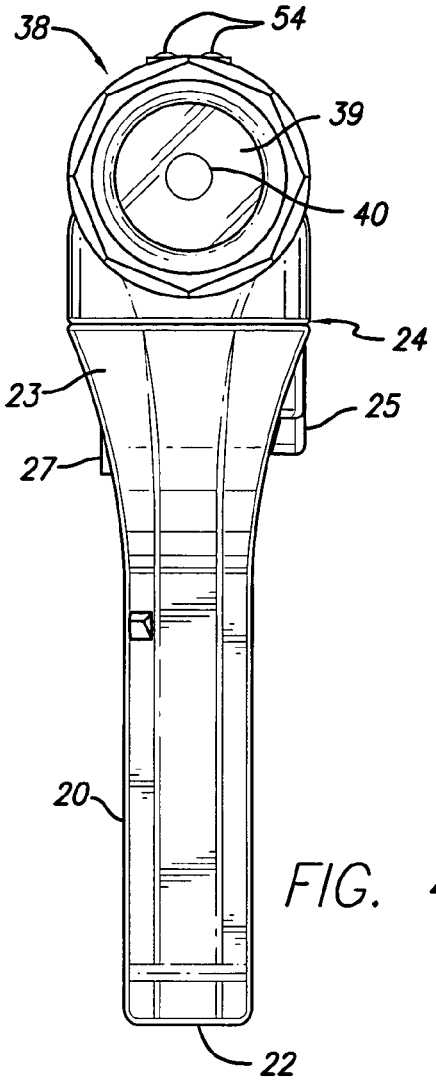
FIG. 4 is a front view of the flashlight as shown in FIG. 1.
Figure 5:
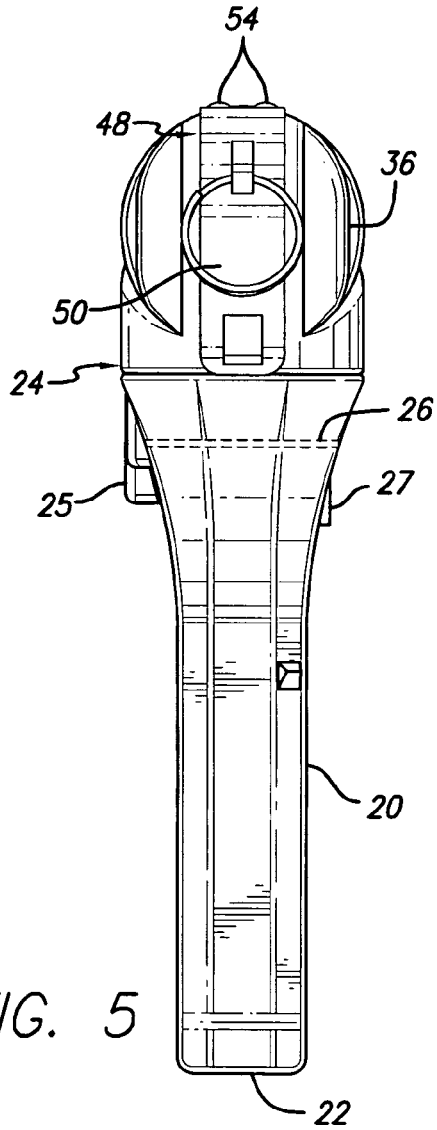
FIG. 5 is a rear view of the flashlight as shown in FIG. 1.
Figure 6:
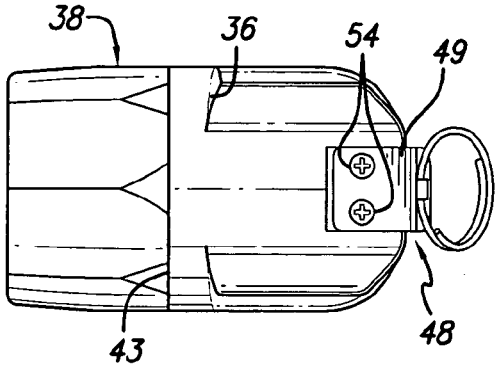
FIG. 6 is a top view of the flashlight as shown in FIG. 1.
Figure 7:
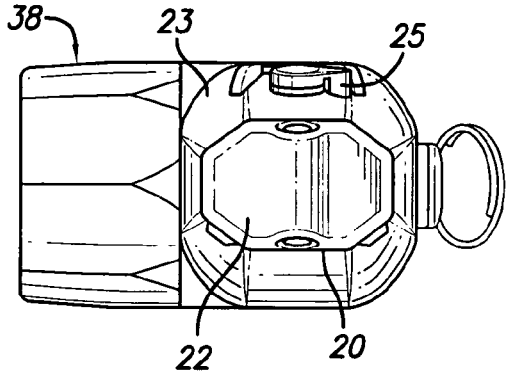
FIG. 7 is an under view of the flashlight as shown in FIG. 1.
Figure 8:
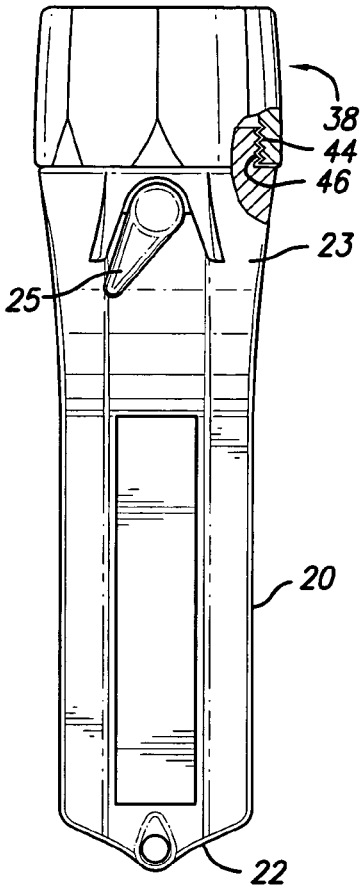
FIG. 8 is a view of the flashlight with a longitudinal barrel and the head directly connected to the longitudinal barrel without an angular connector between them.
Figure 9:
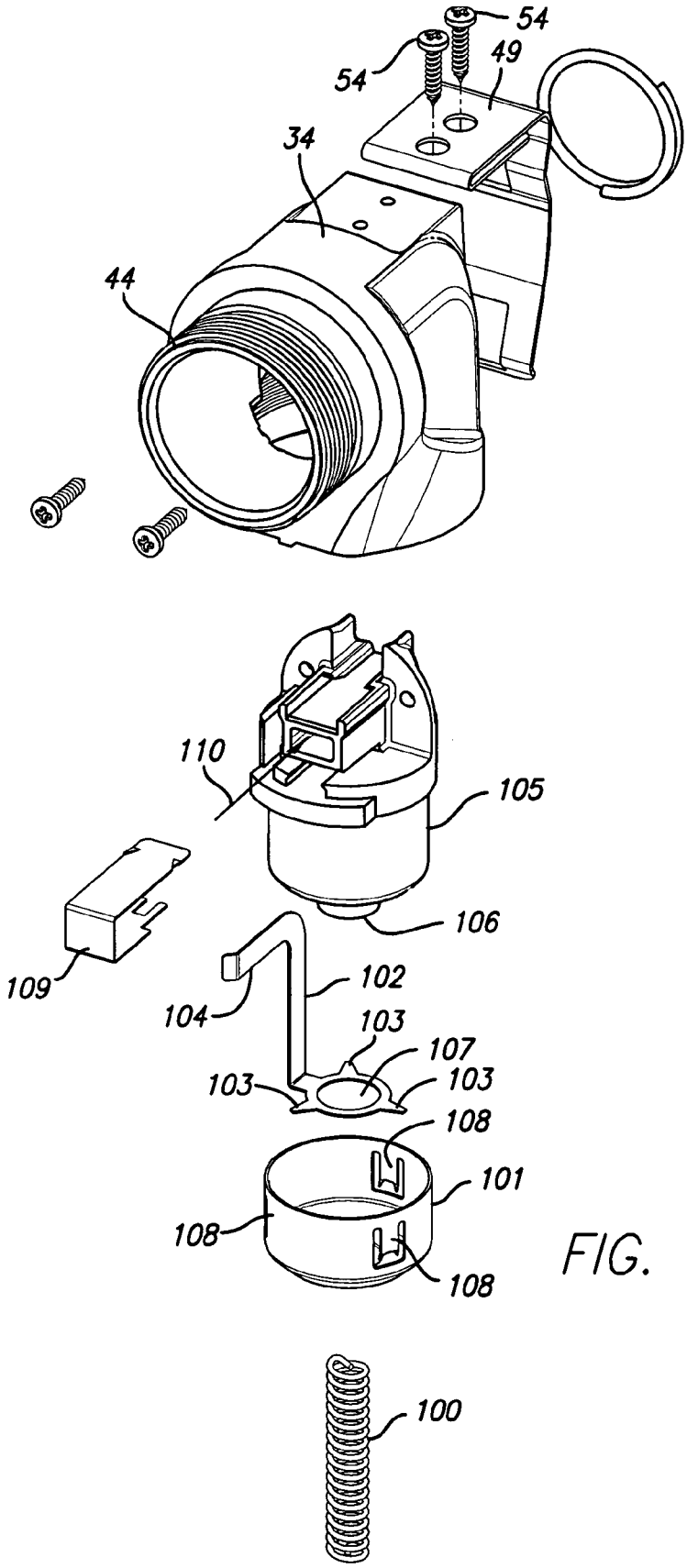
FIG. 9 is an exploded internal view of the flashlight showing the internal contact configurations in the flashlight.
Figure 10:
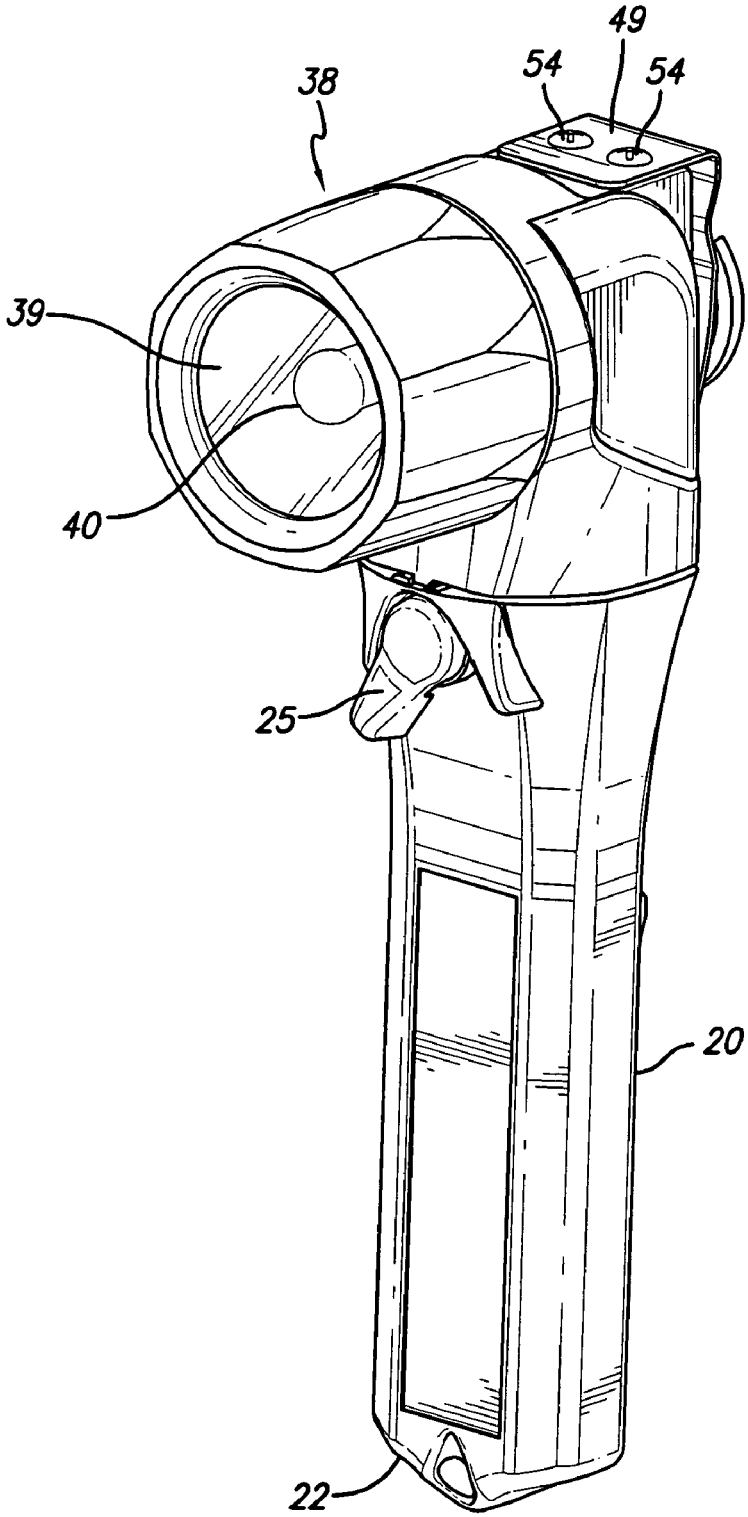
FIG. 10 is a different perspective view of the flashlight shown in FIG. 1. The head is turned through 90° relative to FIG. 1 so that the head is shown over the switch at the top of the barrel.

As shown, the toggle 25 can move from a position depending downwardly from the pin 26 at a position relatively demarcated at "5 o'clock" to a position on the opposite side relatively demarcated at a position of 7 o'clock as indicated by position 33 as shown in FIG. 2. The 5 o'clock position is indicated in FIG. 1 by line 34A.

On top of the barrel 20, there is located an angular connector 34 which has a longitudinally directed portion 35 and a right-angularly directed portion 36. The end 37 of the right-angularly directed portion 36 is connected with a head 38. The head 38 includes a lens 39 and a bulb 40. The angular portion 34 is rotatable radially about a circumference as indicated by arrow 41 about the axis 42. The axis 42 is directed longitudinally through the barrel 20 of the flashlight. As such, the angular connector 34 can be located in different regular positions relative to the axis 42. The head 38 therefore can direct the light from the bulb 40 through the lens 39 in different right angular directions relative to the axis 42. In this manner also the directions of the light can be directed radially in different directions relative to the switch toggle 35.

In other forms of the invention, the angular portion 34 is removed, and the head 38 is directly connected to the upper part 23 of the barrel 20. The trailing portion 43 of the head 38 is provided with a threaded formation 44 for engaging internal threads 45 of the angular connector 34. The upper part 23 of the barrel also includes internal threads 46 which would engage the threads 47 on the end of the angular connector 34.

Without the angular connector 34 in position, the threads 44 at the end of the head 38 engage the threads 46 internally located at the upper part 23 of the barrel. In this manner, the head 38 is directly connected to the top of the barrel and the flashlight can act in a direct longitudinal fashion without the angular connector 34.

This configuration of the flashlight being operable with and without the angular connector 34 permits for the flashlight to operate in a versatile fashion. Thus, the flashlight can operate with the directed radially around a longitudinal line or axis 42 or can act along the longitudinal or axis 42 as desired by the user.

The connector 34 includes a clip 48 which is right angular with a first flat portion 49 and a depending arm 50. The flat portion 49 is affixed by screws or rivets 54 to the top portion of the angular connector 34. The depending plate 50 is spring loaded so that the end 51 is adjacent to the outer wall of the longitudinally directed portion 35.

As such, a support or clothing figuratively indicated as numeral 52 can engage between the end 51 and the portion 35. This permits for the flashlight to be secured effectively to a support sub-strait of clothing as may be desired. This can permit a user's hands to be free for other activities. By locating the screws or rivets 54 on the top portion adjacent to the section 36 rather than on the longitudinal portion 35 of the angular connector 34, a more secure configuration is obtained whereby the clip 48 is less likely to be loosened with use caused by frictional interaction or engagement wit the support or clothing 52 or the environment when the flashlight is placed on its side or the like.

Less force or contact is placed on the screws or rivets 54, thus the attachment method provides for inadvertent pulling out of the screws from the housing of the flashlight.

Many other forms of the invention exists, each different from the other in matters of detail only. For instance, the flashlight can use batteries 28 which are non-rechargeable or rechargeable. If the configuration is going to be used with rechargeable batteries, it is possible to have the flashlight arranged so that rechargeable contacts emanate from the body of the barrel 20 in a desirable fashion. Alternatively, the batteries may be of the rechargeable kind so that they can be located in a recharger and then reused in the barrel of the flashlight.

Internal contact layout of the circuit which closes the connection between the batteries, the switch and the bulb includes a coil spring 100 which urged into engagement with the conductor cup 101 which is a contact which circumferentially surrounds the body 105. A further part of the circuit includes the conductor bar 102 which has radially directed spokes 103 on a lower portion and which engage the inside of the cup 101 in stepped receptors 108 spaced around the cup 101. The upper portion 104 is for engagement with the conductor portion 109 of the contact for the bulb 40. The contact is for location on the top of the housing 105 as indicated by arrow 110. The base 106 of the housing is located in the central bore 107. Coil spring contact 100 is urged onto engagement with the contact 109. This contact 109 then makes contact with the bulb 40. Cup 101 makes contact with the switch contact inside the flashlight. When the switch is activated, the switch contact is urged onto cup 101. Contact 104 makes contact with cup 101 and this in turn makes contact with the negative portion of the bulb 40. Cup 101 and spring contact 100 facilitate the head rotation around the axis of the body.

Many other forms of the invention exist each differing from the other in matters of detail only. For instance, instead of a right angular directed connector, there can be a connector which is at another angle relative to the longitudinal axis. Further the intermediate element between the head and the barrel may also be able to move in different angular direction closer towards or from the longitudinal axis Different switch configurations and mechanisms can be used instead of the finger toggle configuration.

The invention is to be determined by the following claims.

What is claimed is:

1. A flashlight comprising:

a barrel for receiving a battery, the barrel having a longitudinal axis and extending between a top and a base;

a head on the barrel having a lens and a bulb;

an angular connector between the head and the barrel;

a switch with an electrical contact for permitting electrical closure and opening between the battery and the bulb thereby, to permit operation of the flashlight to be on or off according to the position of the switch;

the angular connector being relatively moveable in relationship to the barrel along the longitudinal axis through the barrel whereby the head can be directed to selected different radial directions relative to the longitudinal axis; and the angular connector being relatively removable from its position between the barrel and the head and wherein the head can be located with the barrel without the angular connector thereby to have a configuration for the flashlight wherein the bead is longitudinally located with the barrel.

2. A flashlight is claimed in claim 1 wherein the angular connector is a right angular formation whereby the head is directed substantially perpendicular to the longitudinal axis through the barrel and whereby the head can be located in a selected radial right angular direction relative to the longitudinal direction extending through the barrel.

3. A flashlight is claimed in claim 1 wherein the switch is located on the barrel.

4. A flashlight is claimed in claim 1 including a clip permitting securing of flashlight on a support, the support selectively being a relatively thin substrate selectively an item of clothing of a user of flashlight.

5. A flashlight is claimed in claim 4 wherein the clip is formed on the angular connector and wherein the clip is secured to the angular connector by anchorage to that connector in a position which is not in the longitudinal direction of the barrel.

6. A flashlight is claimed in claim 5 wherein the angular connector includes a longitudinal portion and a portion directed angularly relative to the longitudinal portion and wherein the clip is anchored to the angularly-directed portion.

7. A flashlight is claimed in claim 1 wherein the switch for operating the flashlight includes a radially mounted finger operable toggle, the axis of the toggle being substantially right angular to the longitudinal axis of the barrel.

8. A flashlight is claimed in claim 7 wherein the switch is mounted on the barrel at a position adjacent to an upper part of the barrel.

9. A flashlight comprising:

a barrel for receiving a battery, the barrel having a longitudinal axis and extending between a top and a base;

a head on the barrel having a lens and a bulb;

an angular connector between the head and the barrel;

a switch with electrical contacts for permitting electrical closure and opening between the battery and the bulb thereby to permit operation of the flashlight to be on or off according to the position of the switch;

the angular connector being relatively moveable in relationship to the barrel along the longitudinal axis through the barrel whereby the head can be directed to selected different radial directions relative to the longitudinal axis;

the annular connector being relatively removable from its position between the barrel and the head and wherein the head can be located with the barrel without the angular connector thereby to have a configuration for the flashlight wherein the head is longitudinally located with the barrel; and a contact operable with the switch whereby closure of the circuit is permissible irrespective of the radial position of the angular connector.

10. A flashlight is claimed in claim 9 wherein the angular connector is a right angular formation whereby the head is directed substantially perpendicular to the longitudinal axis through the barrel and whereby the head can be located in a selected radial right angular direction relative to the longitudinal direction extending through the barrel.

11. A flashlight is claimed in claim 9 wherein the contact includes a circumferential element about the axis whereby the contact can be maintained from different radial positions of the barrel relative to the head.

12. A flashlight is claimed in claim 9 wherein the switch for operating the flashlight includes a finger operable toggle.

13. A flashlight is claimed in claim 12 wherein the switch is mounted on the barrel at a position adjacent to an upper part of the barrel.

14. A flashlight comprising:

a barrel for receiving a battery, the barrel having a longitudinal axis and extending between a top and a base;

a head on the barrel having a lens and a bulb;

an angular connector between the head and the barrel;

a switch with an electrical contact for permitting electrical closure and opening between the battery and the bulb thereby to permit operation of the flashlight to be on or off according to the position of the switch;

the angular connector being in relationship to the barrel whereby the head can be directed in a non-longitudinal direction relative to the longitudinal axis; and the angular connector being relatively removable from its position between the barrel and the head and wherein the head can be located with the barrel without the angular connector thereby to have a configuration for the flashlight wherein the head is longitudinally located with the barrel.

* * * * *